US011384658B1

(12) United States Patent
Caulfeild

(10) Patent No.: US 11,384,658 B1
(45) Date of Patent: Jul. 12, 2022

(54) DEFORMABLE BUMPER FOR A ROTATING STRUCTURE OF A TURBINE ENGINE

(71) Applicant: Pratt & Whitney Canada Corp., Longueuil (CA)

(72) Inventor: Stephen Caulfeild, Rockwood (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 17/406,472

(22) Filed: Aug. 19, 2021

(51) Int. Cl.
*F01D 25/16* (2006.01)
*F01D 21/04* (2006.01)

(52) U.S. Cl.
CPC ..... *F01D 21/045* (2013.01); *F01D 25/164* (2013.01); *F05D 2250/283* (2013.01); *F05D 2260/96* (2013.01)

(58) Field of Classification Search
None
See application file for complete search history.

(56) References Cited

U.S. PATENT DOCUMENTS 3,901,557 A 8/1975 Daniels
4,117,359 A * 9/1978 Wehde ..... D01H 4/14 57/406
4,306,755 A 12/1981 Roberts
5,102,237 A * 4/1992 Ide ..... F16C 17/065 384/224
5,304,006 A * 4/1994 Ide ..... F16C 17/065 384/117
5,791,789 A 8/1998 Van Duyn
10,422,431 B2 9/2019 Chuong
10,767,690 B2 9/2020 Wojtyczka
2007/0261516 A1* 11/2007 Saito ..... F16H 49/001 74/640
2011/0058759 A1* 3/2011 Herborth ..... F16C 27/045 384/55
2017/0211658 A1* 7/2017 Willems ..... F16F 15/18

* cited by examiner

*Primary Examiner* — Michael Lebentritt
(74) *Attorney, Agent, or Firm* — Getz Balich LLC

(57) ABSTRACT

An assembly is provided for a turbine engine. This turbine engine assembly includes a stationary structure, a rotating structure, a bearing. The rotating structure rotatable about an axis relative to the stationary structure. The bearing supports the rotating structure. The stationary structure includes a flexible bearing support and a crushable bumper. The flexible bearing support supports the bearing. The crushable bumper is arranged radially outward of and axially overlaps the flexible bearing support. The stationary structure is configured such that: the flexible bearing support is disengaged from the crushable bumper during a first mode of operation; and the flexible bearing support contacts the crushable bumper during a second mode of operation.

20 Claims, 9 Drawing Sheets

DEFORMABLE BUMPER FOR A ROTATING STRUCTURE OF A TURBINE ENGINE

TECHNICAL FIELD

This disclosure relates generally to a turbine engine and, more particularly, to a bearing support for a turbine engine.

BACKGROUND

A gas turbine engine includes a stationary structure and a rotating structure rotatably mounted with the stationary structure via a plurality of bearings. Under certain conditions, one or more portions of the rotating structure may vibrate, wobble and/or otherwise shift relative to the stationary structure. Various devices and systems are known in the art for accommodating and/or controlling such shifting between the rotating structure and the stationary structure. While these known devices and systems have various benefits, there is still room in the art for improvement.

SUMMARY OF THE DISCLOSURE

According to an aspect of the present disclosure, an assembly is provided for a turbine engine. This turbine engine assembly includes a stationary structure, a rotating structure and a bearing. The rotating structure rotatable about an axis relative to the stationary structure. The bearing supports the rotating structure. The stationary structure includes a flexible bearing support and a crushable bumper. The flexible bearing support supports the bearing. The crushable bumper is arranged radially outward of and axially overlaps the flexible bearing support. The stationary structure is configured such that: the flexible bearing support is disengaged from the crushable bumper during a first mode of operation; and the flexible bearing support contacts the crushable bumper during a second mode of operation.

According to another aspect of the present disclosure, another assembly is provided for a turbine engine. This turbine engine assembly includes a rotating structure, a bearing and a stationary structure. The bearing supports the rotating structure. The stationary structure includes a bearing support and a bumper. The bearing support is cantilevered from another portion of the stationary structure. The bearing support includes a plurality of beams and a bearing support section. The beams are distributed circumferentially about an axis and project axially along the axis to the bearing support section. The bearing is mounted to the bearing support section at an unsupported end of the bearing support. The bumper is configured to deform when the bearing support section subjects the bumper to a radial load over a threshold.

According to still another aspect of the present disclosure, another assembly is provided for a turbine engine. This turbine engine assembly includes a rotating structure, a bearing, a bearing support and a deformable bumper. The bearing supports the rotating structure. The bearing support supports the bearing. The deformable bumper is configured to damp radial movement of the bearing support. The deformable bumper includes a porous structure with an inner portion and an outer portion. The inner portion is radially between the outer portion and the bearing support. The inner portion has an inner portion density. The outer portion has an outer portion density that is different than the inner portion density.

An annular gap may be formed radially between the flexible bearing support and the crushable bumper during the first mode of operation.

The flexible bearing support may also be configured to crush the crushable bumper during the second mode of operation.

The flexible bearing support may also be configured to permanently deform the crushable bumper during the second mode of operation.

The crushable bumper may circumscribe the flexible bearing support.

A first portion of the crushable bumper may be configured to crush when subject to a first load. A second portion of the crushable bumper may be configured to crush when subject to a second load that is different than the first load.

The first load may be greater than the second load. The first portion of the crushable bumper may be arranged radially between the second portion of the crushable bumper and the flexible bearing support.

The first load may be greater than the second load. The second portion of the crushable bumper may be arranged radially between the first portion of the crushable bumper and the flexible bearing support.

The first portion of the crushable bumper may include a first cavity with a first dimension in a direction. The second portion of the crushable bumper may include a second cavity with a second dimension in the direction. The second dimension may be different than the first dimension.

The first portion of the crushable bumper may have a first porosity. The second portion of the crushable bumper may have a second porosity that is different than the first porosity.

The first portion of the crushable bumper may include an empty cavity. The second portion of the crushable bumper may include a cavity at least partially filled with filler material.

The crushable bumper may be configured from or otherwise include honeycomb.

The crushable bumper may be configured from or otherwise include foam.

The crushable bumper may be configured from or otherwise include a lattice structure.

The stationary structure may also include a fixed support. The crushable bumper may be mounted to the fixed support.

A radial outer side of the fixed support may be configured to form a peripheral boundary of a flowpath within the turbine engine.

The flexible bearing support may be a cantilevered from another portion of the stationary structure. The bearing may be supported by a distal, unsupported end portion of the flexible bearing support.

The flexible bearing support may include a mount section, a bearing support section and a spring section axially between and connected to the mount section and the bearing support section. The bearing may be mounted to the bearing support section. The spring section may include a plurality of slots arranged circumferentially about a rotational axis of the rotating structure. Each of the slots may extend radially through the spring section.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
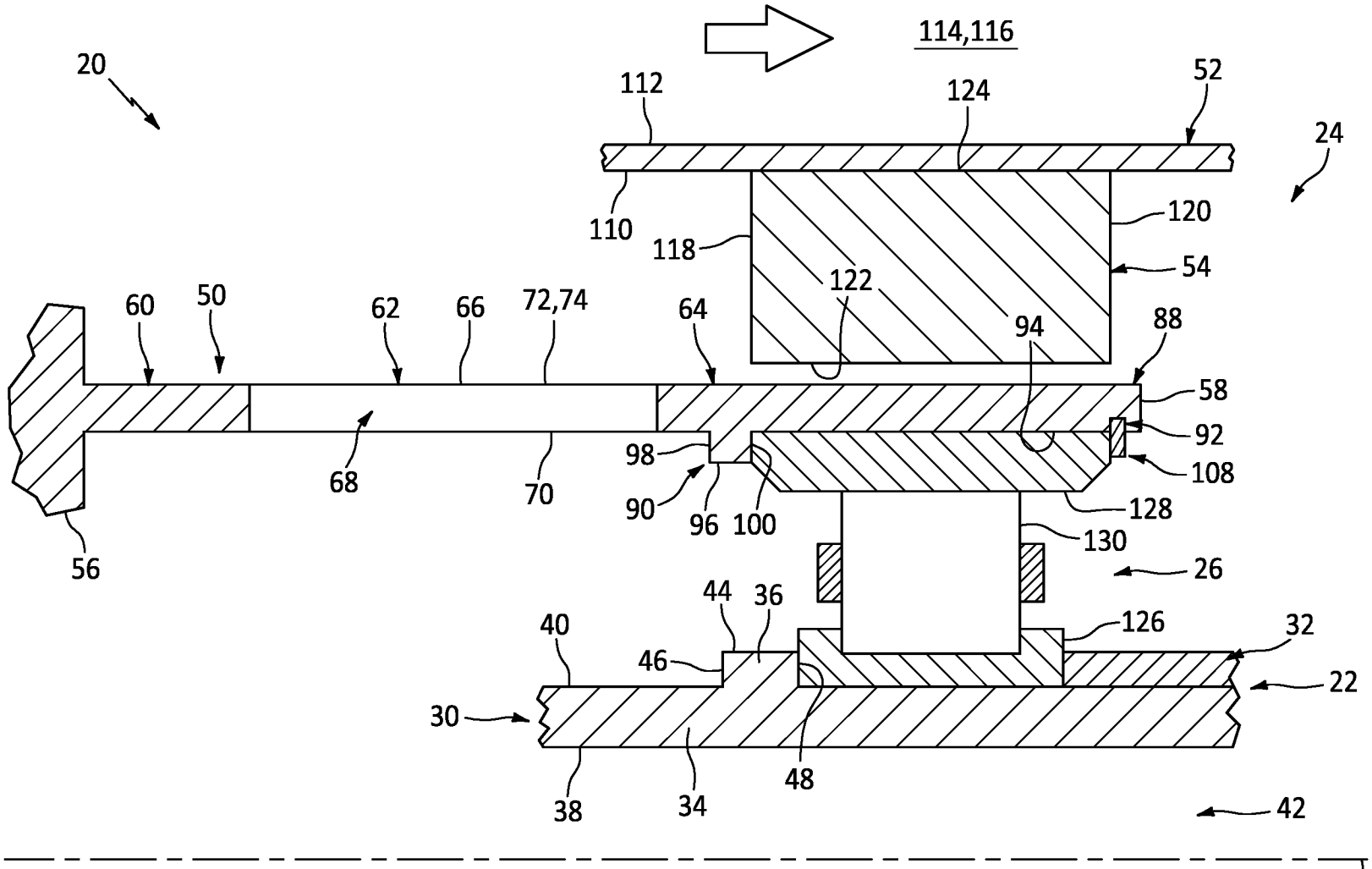
FIG. 1 is a partial sectional illustration of an assembly for a turbine engine.

FIG. 1 illustrates an assembly 20 for a turbine engine. This turbine engine assembly 20 includes a rotating structure 22, a stationary structure 24 and at least one bearing 26 rotatably mounting the rotating structure 22 with the stationary structure 24.

The rotating structure 22 extends axially along and is rotatable about a rotational axis 28, which rotational axis 28 may be coaxial with an axial centerline of the turbine engine assembly 20. The rotating structure 22 of FIG. 1 includes a shaft 30 and a second component 32. Examples of the second component 32 of the rotating structure 22 include, but are not limited to, a sleeve, a spacer, a baffle, another shaft, a coupling, a seal land and a retainer (e.g., a clip, a nut, etc.).

The shaft 30 of FIG. 1 includes a (e.g., tubular) shaft base 34 and a (e.g., annular) shaft shoulder 36. The shaft base 34 extends axially along and circumferentially about (e.g., completely around) the rotational axis 28. The shaft base 34 extends radially between and to an inner side 38 of the shaft 30 and an outer side 40 of the shaft base 34. The shaft inner side 38 of FIG. 1 forms an internal bore 42 within the shaft 30, which internal bore 42 extends axially within (e.g., and into, or through) the shaft 30 and its shaft base 34.

The shaft shoulder 36 is connected to the shaft base 34 at the base outer side 40. The shaft shoulder 36 of FIG. 1 projects radially out from the shaft base 34 and its base outer side 40 to a distal end 44 of the shaft shoulder 36. The shaft shoulder 36 of FIG. 1 extends axially along the rotational axis 28 between and to a first side 46 of the shaft shoulder 36 and a second side 48 of the shaft shoulder 36. The shaft shoulder 36 may extend circumferentially about (e.g., completely around) the rotational axis 28.

The stationary structure 24 of FIG. 1 includes a bearing support 50, a fixed support 52 and a bumper 54.

Figure 2:
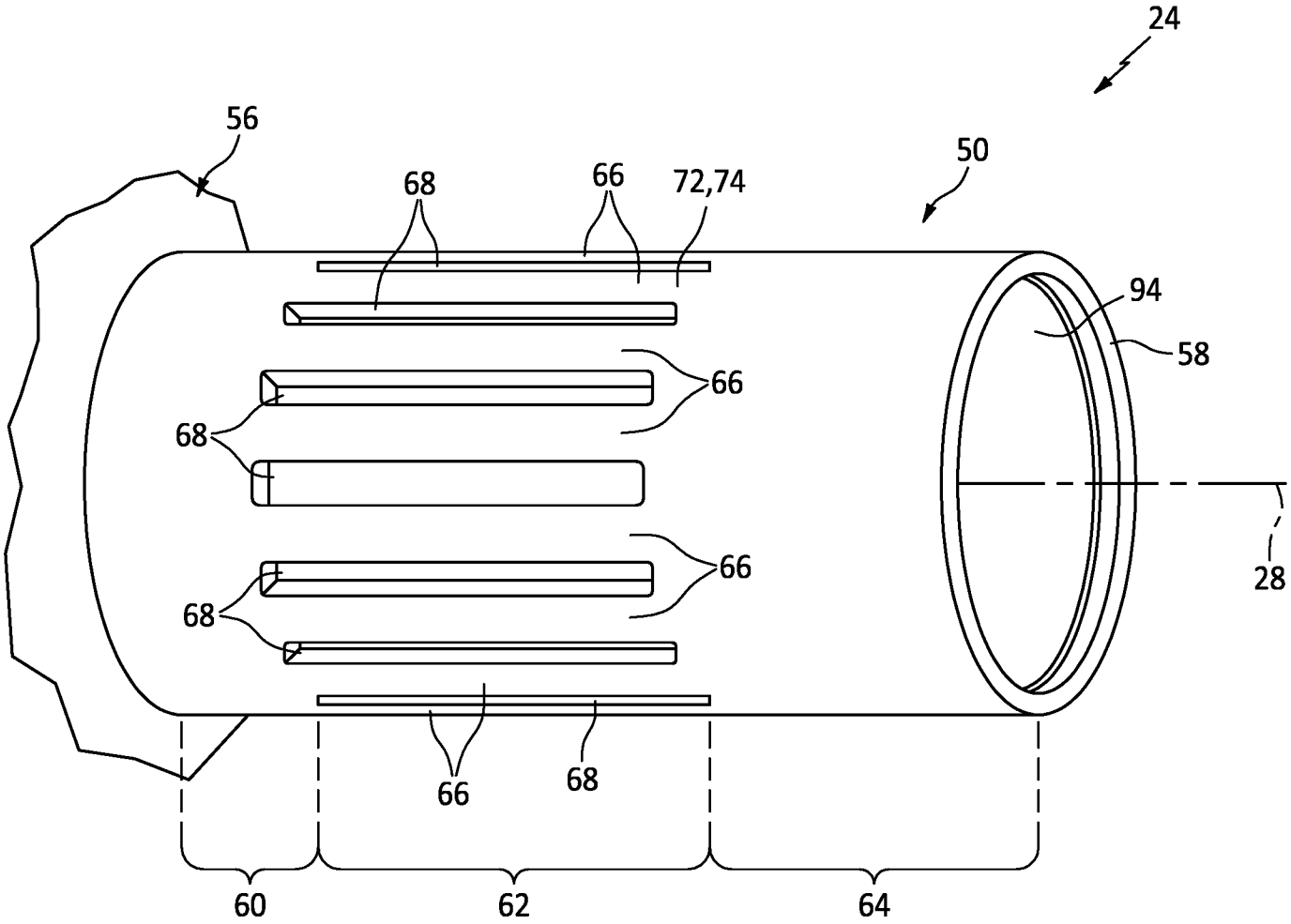
FIG. 2 is a perspective illustration of a bearing support connected to another portion of a stationary structure.

The bearing support 50 of FIG. 1 is cantilevered from another portion 56 of the stationary structure 24. The bearing support 50, for example, projects axially along the rotational axis 28 out from the stationary structure portion 56 to a distal (e.g., unsupported) end 58 of the bearing support 50. Referring to FIG. 2, the bearing support 50 extends circumferentially about (e.g., completely around) the rotational axis 28, thereby providing the bearing support 50 with a tubular body. The bearing support 50 may be configured as a flexible bearing support. The bearing support 50 of FIG. 2, for example, includes a mount section 60, an intermediate (e.g., spring) section 62 and a bearing support section 64.

The mount section 60 extends axially along the rotational axis 28 between and to the stationary structure portion 56 and the intermediate section 62. The mount section 60 is connected to (e.g., formed integral with or otherwise attached to) the stationary structure portion 56 and the intermediate section 62. The mount section 60 thereby connects and structurally ties the bearing support 50 to the stationary structure portion 56. The mount section 60 of FIG. 2 extends circumferentially about (e.g., completely around) the rotational axis 28, and may be circumferentially and/or axially uninterrupted.

The intermediate section 62 extends axially along the rotational axis 28 between and to the mount section 60 and the support section 64. The intermediate section 62 is connected to (e.g., formed integral with or otherwise attached to) the mount section 60 and the support section 64. The intermediate section 62 thereby connects and structurally ties the support section 64 to the mount section 60. Furthermore, under normal operating conditions, the intermediate section 62 may provide the only structural support for the support section 64 given, for example, the cantilevered connection of the bearing support 50 to the stationary structure portion 56. The intermediate section 62 of FIG. 2 extends circumferentially about (e.g., completely around) the rotational axis 28, and may be circumferentially and/or axially interrupted; e.g., configured as a squirrel cage spring. The intermediate section 62 of FIG. 2, for example, includes a plurality of beams 66 and/or a plurality of slots 68.

The beams 66 and the slots 68 are distributed circumferentially about the rotational axis 28. The beams 66 are interspersed with the slots 68 such that: (A) each of the beams 66 is disposed and extends laterally (e.g., circumferentially or tangentially) between a respective lateral neighboring (e.g., adjacent) pair of the slots 68; and (B) each of the slots 68 is disposed and extends laterally within the intermediate section 62 between a respective laterally neighboring pair of the beams 66. Each of the beams 66 extends axially along the rotational axis 28 between and is connected to the mount section 60 and the support section 64. Each of the slots 68 extends axially along the rotational axis 28 within the bearing support 50 (and through the intermediate section 62) between and to the mount section 60 and the support section 64. Referring to FIG. 1, each of the slots 68 extends (e.g., completely) radially through the bearing support 50 and its intermediate section 62 between and to an inner side 70 of the intermediate section 62 and an outer side 72 of the intermediate section 62, which may also be an outer side 74 of the bearing support 50.

Figure 3:
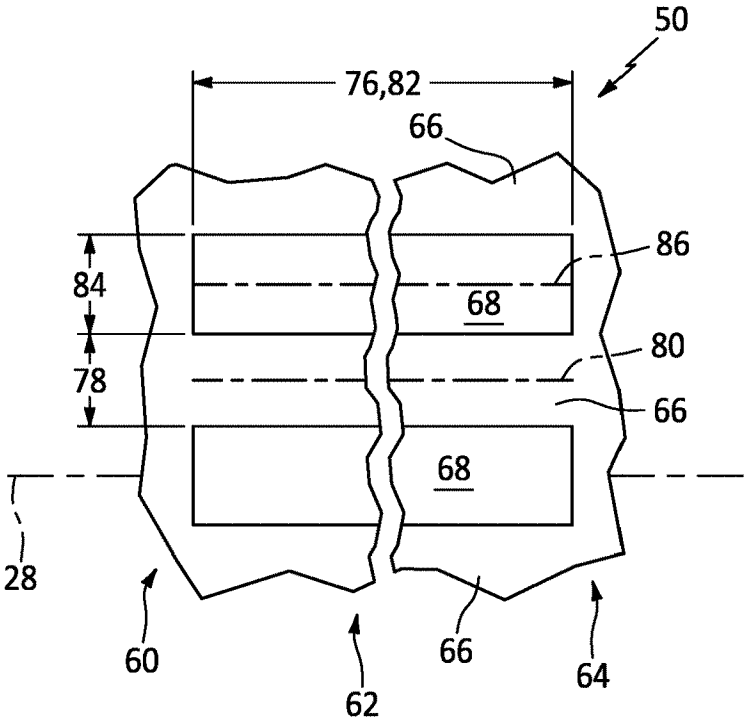
FIG. 3 is a side illustration of a portion of the bearing support.

Referring to FIG. 3, each of the beams 66 has a longitudinal length 76 and a lateral width 78. The beam longitudinal length 76 is measured along a longitudinal centerline 80 of the respective beam 66 from the mount section 60 to the support section 64. Each beam longitudinal centerline 80 of FIG. 3 is straight and parallel with the rotational axis 28; however, the present disclosure is not limited to such an exemplary configuration. The beam lateral width 78 is measured between opposing lateral sides of the respective beam 66; e.g., between the respective laterally neighboring pair of the slots 68.

Each of the slots 68 has a longitudinal length 82 and a lateral width 84, where the slot longitudinal length 82 is equal to the beam longitudinal length 76 and the slot lateral width 84 may be equal to or different (e.g., greater or less) than the beam lateral width 78. The slot longitudinal length 82 is measured along a longitudinal centerline 86 of the respective slot 68 from the mount section 60 to the support section 64. Each slot longitudinal centerline 86 of FIG. 3 is straight and parallel with the rotational axis 28; however, the present disclosure is not limited to such an exemplary configuration. The slot lateral width 84 is measured between opposing lateral sides of the respective slot 68; e.g., between the respective laterally neighboring pair of the beams 66.

The dimensions (e.g., 76, 78, 82, 84) of the beams 66 and the slots 68 are selected to tune the intermediate section 62 to provide the bearing support 50 with a certain amount of flexibility. For example, referring to FIG. 1, the intermediate section 62 and its beams 66 may be configured to facilitate a certain degree of twist between the support section 64 and the mount section 60 about the rotational axis 28. The intermediate section 62 and its beams 66 may also or alternatively be configured to facilitate a certain degree of radial displacement between the support section 64 and the mount section 60. The intermediate section 62 may thereby accommodate slight shifts between and/or vibrations in the rotating structure 22 and the stationary structure 24.

The support section 64 of FIG. 2 extends axially along the rotational axis 28 between and to the intermediate section 62 and the support distal end 58. The support section 64 of FIG. 2 extends circumferentially about (e.g., completely around) the rotational axis 28, and may be circumferentially and/or axially uninterrupted. The support section 64 of FIG. 1 includes a support section base 88, a support section shoulder 90 and a support section slot 92.

The section base 88 extends axially along and circumferentially about (e.g., completely around) the rotational axis 28. The section base 88 extends radially between and to an inner side 94 of the section base 88 (e.g., the intermediate section inner side 70) and the support outer side 74.

The section shoulder 90 is connected to the section base 88 at the base inner side 94. The section shoulder 90 of FIG. 1 projects radially inward from the section base 88 and its base inner side 94 to a distal end 96 of the section shoulder 90. The section shoulder 90 of FIG. 1 extends axially along the rotational axis 28 between and to a first side 98 of the section shoulder 90 and a second side 100 of the section shoulder 90. The section shoulder 90 may extend circumferentially about (e.g., completely around) the rotational axis 28.

Figure 4:
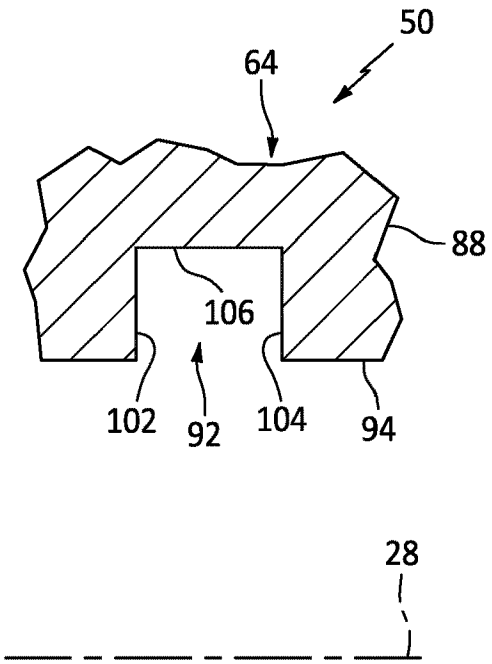
FIG. 4 is a sectional illustration of another portion of the bearing support.

The section slot 92 is arranged at (e.g., on, adjacent or proximate) the support distal end 58. The section slot 92 extends circumferentially about (e.g., completely around) the rotational axis 28 within the section base 88. Referring to FIG. 4, the section slot 92 extends axially along the rotational axis 28 within the section base 88 between and to opposing sides 102 and 104 of the section slot 92. The section slot 92 projects radially into the section base 88 from the support inner side 94 to an end 106 of the section slot 92. Referring again to FIG. 1, the section slot 92 may be configured as a receptacle for an annular retainer 108 (e.g., a split ring).

The fixed support 52 may be structurally tied to the stationary structure portion 56. The fixed support 52 of FIG. 1 extends axially along the rotational axis 28. The fixed support 52 extends circumferentially about (e.g., completely around) the rotational axis 28. The fixed support 52 projects radially inward (e.g., towards the rotational axis 28) to an inner side 110 of the fixed support 52. The fixed support 52 may project radially outwards (e.g., away from the rotational axis 28) to an outer side 112 of the fixed support 52. This fixed support outer side 112 may form a (e.g., inner) peripheral boundary of a volume 114 outside of a bearing compartment 116 housing the bearing 26, which volume 114 may be a flowpath 116 within the turbine engine.

Figure 5:
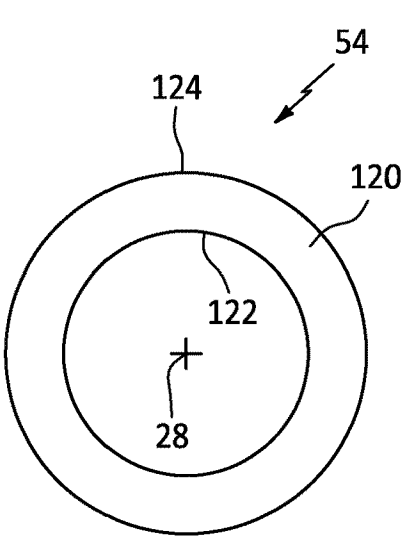
FIG. 5 is an end illustration of a bumper.

The bumper 54 extends axially along the rotational axis 28 between and to opposing ends 118 and 120 of the bumper 54. Referring to FIG. 5, the bumper 54 extends circumferentially about (e.g., completely around) the rotational axis 28, thereby providing the bumper 54 with a full hoop body. The bumper 54 of FIGS. 1 and 5 is circumferentially and/or axially uninterrupted, and may be forms as a single unitary (e.g., monolithic) body. The bumper 54 of FIG. 1 extends radially between and to an inner side 122 of the bumper 54 and an outer side 124 of the bumper 54.

Referring to FIGS. 6A-D, the bumper 54 is configured as a (e.g., permanently) deformable body. More particularly, the bumper 54 may be configured as a (e.g., radially) crushable body. The bumper 54 may have various configurations to tune its deformation (e.g., crushability), various examples of which are described below with reference to FIGS. 7A-13. The present disclosure, however, is not limited to such exemplary bumper configurations.

The bumper outer side 124 of FIG. 1 may be abutted against and/or otherwise radially engage (e.g., contact) the fixed support 52 and its inner side 110. The bumper 54 is also mounted to the fixed support 52. The bumper 54, for example, may be fixedly secured to the fixed support 52 through a mechanical coupling (e.g., via interference fit, mechanical fastener, etc.), a bond (e.g., weld, braze, adhesive, etc.) joint and/or any other attachment technique.

The bumper 54 of FIG. 1 is radially outboard of and extends circumferentially about (e.g., completely around) each of the turbine engine assembly elements 22, 26, 30, 50 and 64. The bumper 54 is axially aligned with the bearing support 50 and its support section 64. The bumper 54 of FIG. 1, for example, axially overlaps the support section 64 at (or near) the support distal end 58.

The bearing 26 may be configured as a roller element bearing. The bearing 26 of FIG. 1, for example, includes a (e.g., tubular) inner race 126, a (e.g., tubular) outer race 128 and a plurality of bearing elements 130. These bearing elements 130 are arranged circumferentially about the rotational axis 28 in an annular array. The bearing elements 130 are located radially between and radially engaged with the inner race 126 and the outer race 128.

The inner race 126 is mounted to the rotating structure 22. The inner race 126 of FIG. 1, for example, circumscribes and radially engages (e.g., contacts) the shaft base 34 and a surface thereof at its outer side 40. The inner race 126 is axially captured and clamped between the shaft shoulder 36 and the second component 32 of the rotating structure 22. The inner race 126 may thereby be fixed to and rotatable with the rotating structure 22.

The outer race 128 is mounted to the stationary structure 24 and, more particularly, to the support section 64 at (e.g., on, adjacent or proximate) the support distal end 58. The outer race 128 of FIG. 1, for example, is arranged within a bore of the bearing support 50 and its support section 64, which support section 64 circumscribes and radially engages (e.g., contacts) the outer race 128 and an outer surface thereof. The outer race 128 is axially captured and clamped between the section shoulder 90 and the retainer 108. The outer race 128 may also or alternatively be mechanically fixed (e.g., press fit) into the bore of the support section 64.

The outer race 128 may thereby be fixed to the stationary structure 24 and its bearing support 50.

Figure 6B:
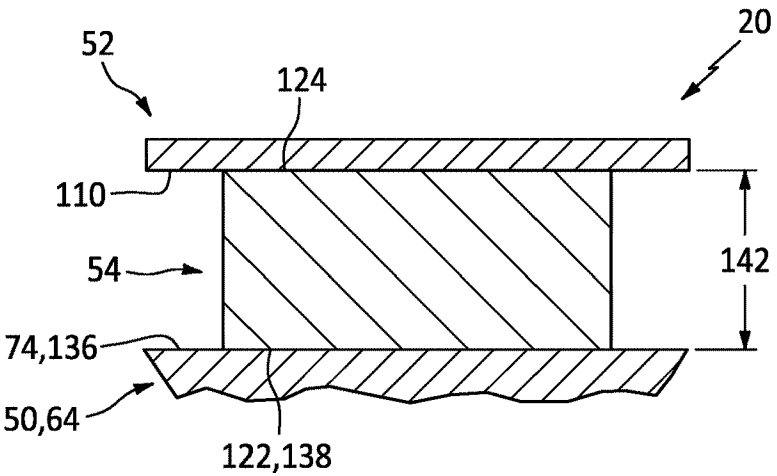
FIGS. 6A-D are partial sectional illustrations of the turbine engine assembly during different modes of operation.
Figure 6A:
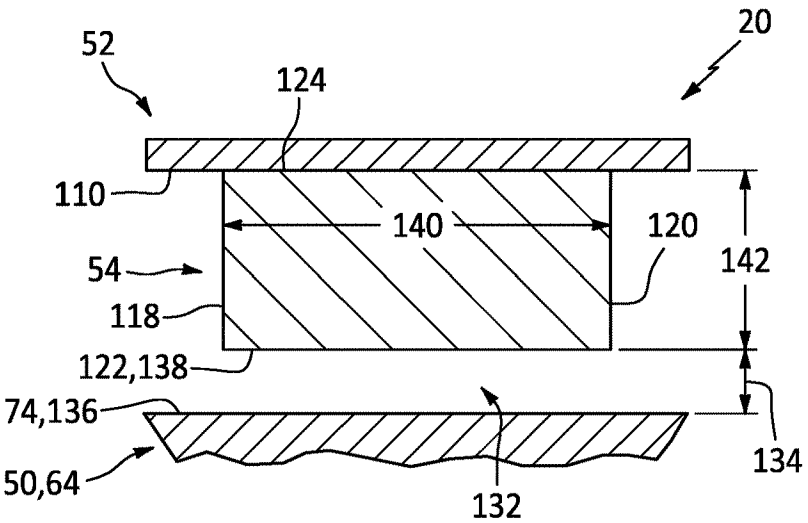

Referring to FIG. 6A, during a mode of nominal (e.g., normal) turbine engine operation as well as when the turbine engine is non-operational, the bumper 54 is radially displaced from the bearing support 50 and its support section 64 by an (e.g., annular) air gap 132. This air gap 132 has a height 134 with a first value. This gap height 134 extends radially between and to an (e.g., cylindrical) outer surface 136 of the support section 64 at the support outer side 74 and an (e.g., cylindrical) inner surface 138 of the bumper 54 at the bumper inner side 122. The air gap 132 extends axially along the surfaces 136 and 138 for a (e.g., entire) length 140 of the bumper 54, which bumper length 140 extends between and to the bumper sides 118 and 120. The air gap 132 extends circumferentially about (e.g., completely around) the rotational axis 28, thereby forming the air gap 132 as an annulus which circumscribes the support section 64.

With the arrangement of FIG. 6A, the bumper 54 is (e.g., completely) structurally disengaged from (e.g., does not contact and/or structurally support) the bearing support 50 and its support section 64. The bumper 54 also has a height 142 with a first value. This bumper height 142 extends radially between and to the bumper inner side 122 and the bumper outer side 124.

Referring to FIG. 6B, during a first mode of off-nominal (e.g., abnormal) turbine engine operation, a first (e.g., shock and/or imbalance) load may radially displace the rotating structure 22 (see FIG. 1). This first load is equal to or greater than a first threshold, but less than a second threshold. The first load may be generated during and/or follow from an off-nominal operating condition and/or event such as, but not limited to, a partial blade off event and/or a relatively large rotating structure imbalance. The radial displacement of the rotating structure 22 displaces the bearing 26 and the bearing support 50 radially outward. The support section 64 and its outer surface 136 may thereby temporarily radially engage (e.g., contact) the bumper 54 and its inner surface 138.

During the first mode of off-nominal turbine engine operation, the bumper 54 provides a radial stop (e.g., a bump stop) for the rotating structure radial displacement. While the bumper 54 may slightly deform upon initial engagement (e.g., impact) between the surfaces 136 and 138, this deformation may be elastic/resilient. Thus, the bumper height 142 may have a second value that is substantially (e.g., +/−2%) or exactly equal to the bumper height first value. A configuration of the bumper 54 may thereby remain substantially unchanged between the mode of nominal turbine engine operation and the first mode of off-nominal turbine engine operation.

Figure 6D:
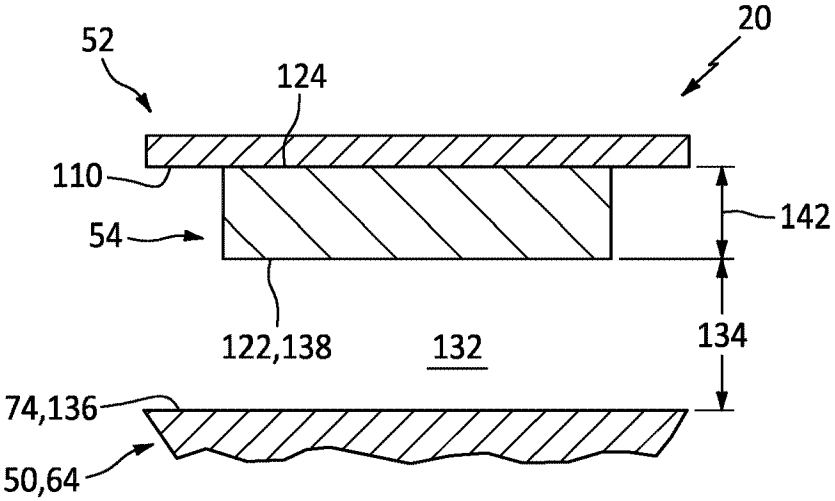
Figure 6C:
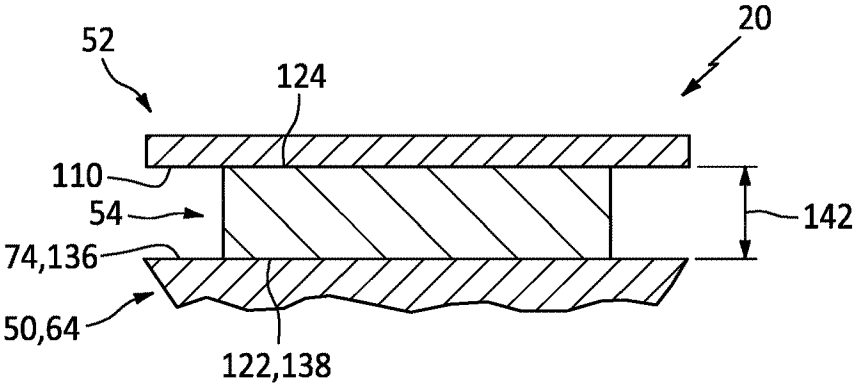

Referring to FIG. 6C, during a second mode of off-nominal turbine engine operation, a second (e.g., shock and/or imbalance) load may radially displace the rotating structure 22 (see FIG. 1). This second load is equal to or greater than the second threshold. The second load may be generated during and/or follow from an off-nominal operating condition and/or event such as, but not limited to, a full blade off event. The radial displacement of the rotating structure 22 displaces the bearing 26 and the bearing support 50 radially outward. The support section 64 and its outer surface 136 may thereby temporarily radially engage (e.g., contact) the bumper 54 and its inner surface 138.

During the second mode of off-nominal turbine engine operation, the bumper 54 again provides a radial stop for the rotating structure radial displacement. The bumper 54 may also provide a damper (e.g., a shock absorber) for the displaced rotating structure 22. For example, where an impact and/or pressure force of the support section 64 against the bumper 54 is equal to or greater than a deformation threshold, the bumper 54 may (e.g., permanently) deform radially outward. The radial displacement of the rotating structure 22, more particularly, presses the support section 64 radially against and at least partially crushes the bumper 54. This crushing may provide a relatively gradual braking effect for the radial rotating structure displacement, as compared to the support section 64 hitting against a non-deformable stop. Providing such a gradual braking effect may reduce or prevent further damage to the rotating structure 22 and/or other components of the turbine engine. The crushing may also tune a response of the rotating structure 22, for example, by changing rotor-dynamic modes. Following this deformation (e.g., crushing), the bumper height 142 has a third value that is less than the bumper height first and second values. The bumper height third value, for example, may be less than four-fifths (4/5), two-thirds (2/3), one-half (1/2), one-third (1/3) or otherwise of the bumper height first value. The present disclosure, however, is not limited to the foregoing exemplary dimensional relationship.

Referring to FIG. 6D, following the second mode of off-nominal turbine engine operation, the bumper 54 may remain substantially or completely deformed. The bumper height 142, for example, may have a fourth value that is substantially (e.g., +/−2%) or exactly equal to the bumper height third value. Thus, when the turbine engine is non-operational for example, the gap height 134 has a second value that is greater than the gap height first value (see FIG. 6A) prior to the deformation (e.g., crushing) of the bumper 54.

Referring to FIGS. 7A-9, the bumper 54 is configured with a porous body. The bumper 54 of FIGS. 7A-9, for example, includes a plurality of internal cavities 144 (e.g., pores, chambers, interstices), which cavities 144 provide space for the bumper 54 to deform; e.g., crush. One or more of the cavities 144 may be configured as separate, fluidly discrete cavities. One or more of the cavities 144 may also or alternatively be fluidly coupled with another one or more of the cavities 144; e.g., the cavities 144 may be interconnected to provide a volume. The bumper 54 is constructed from a bumper material such as, but not limited to, a metal, a polymer, a composite material or a combination thereof.

Figure 7B:
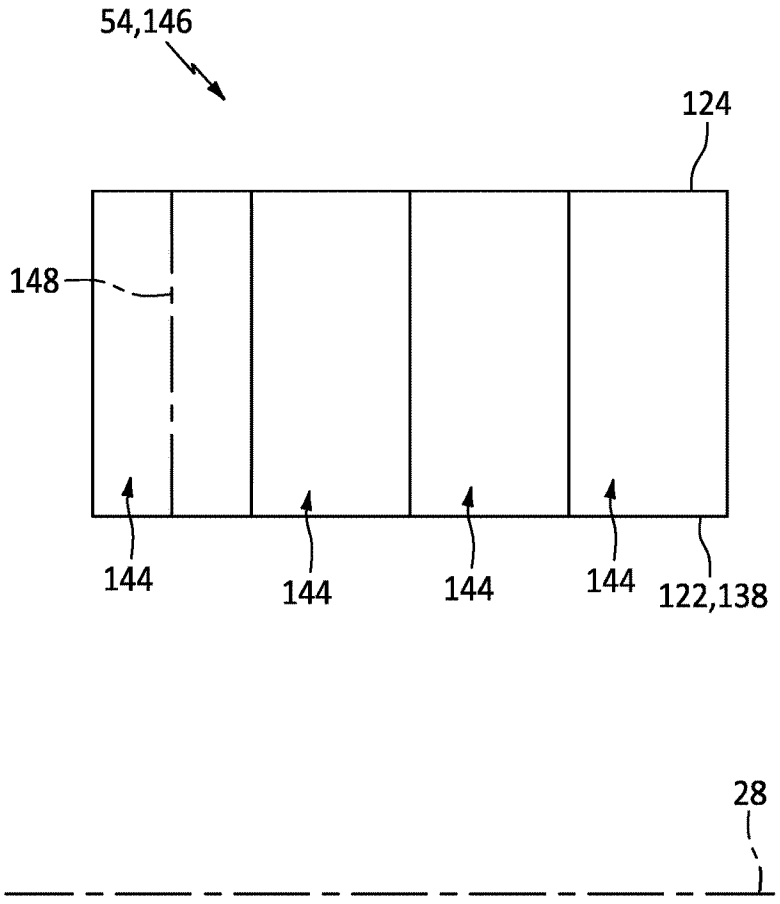
FIG. 7B is a sectional illustration of the bumper portion of FIG. 7A.
Figure 7A:
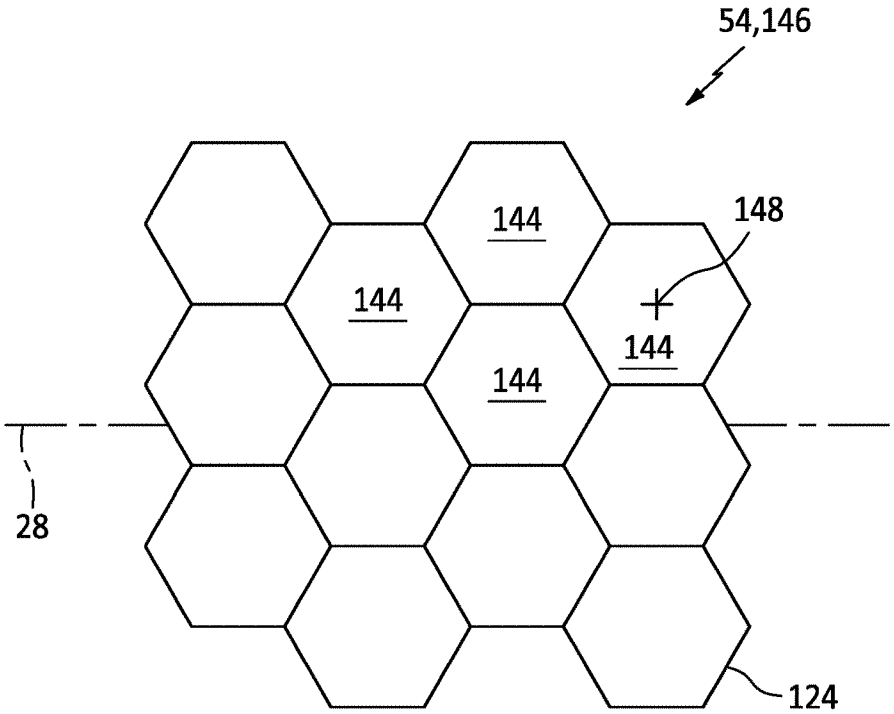
FIG. 7A is a side illustration of a portion of the bumper configured from honeycomb.

In some embodiments, referring to FIGS. 7A and 7B, the bumper 54 may be configured with or otherwise include honeycomb 146; e.g., a honeycomb body. Each cavity 144 of FIG. 7A, for example, is configured with a polygonal (e.g., hexagonal) cross-sectional geometry when viewed, for example, in a plane perpendicular to a centerline 148 of the respective cavity 144. Referring to FIG. 7B, the cavity centerline 148 may be arranged perpendicular to the bumper inner surface 138/the bumper inner side 122. Each cavity 144 of FIG. 7B, for example, may extends longitudinally along its cavity centerline 148 between and to (or about) the bumper inner side 122 and the bumper outer side 124.

Figure 8B:
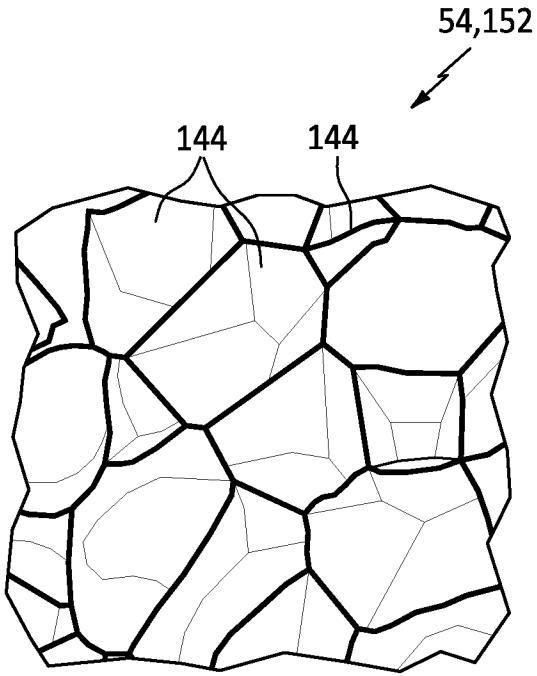
FIG. 8B is a sectional illustration of a portion of the bumper configured from closed-cell foam.
Figure 8A:
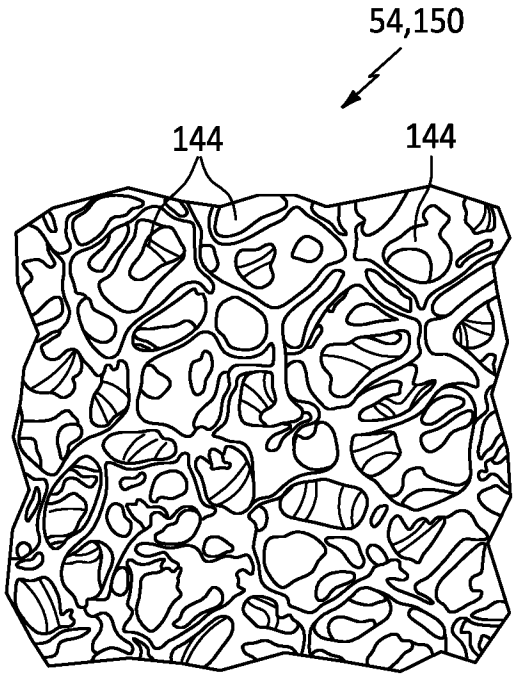
FIG. 8A is a sectional illustration of a portion of the bumper configured from open-cell foam.

In some embodiments, referring to FIGS. 8A and 8B, the bumper 54 may be configured with or otherwise include foam; e.g., a foam body. Referring to FIG. 8A, the foam may be configured as open cell foam 150 where its internal cavities 144 (e.g., pores) are interconnected. Referring to FIG. 8B, the foam may alternatively be configured as closed cell foam 152 where its internal cavities 144 are discrete.

Figure 9:
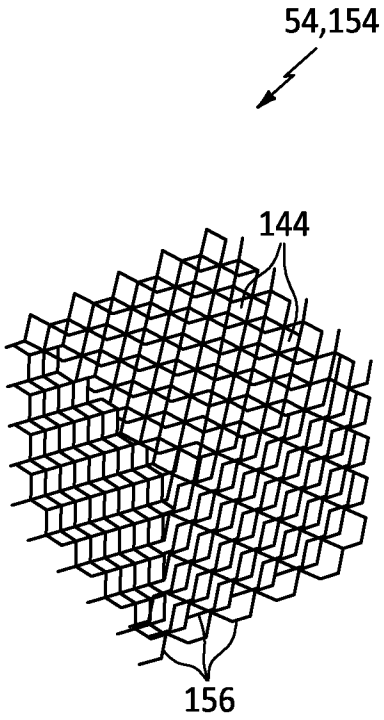
FIG. 9 is a perspective illustration of a portion of the bumper configured from a lattice structure.

In some embodiments, referring to FIG. 9, the bumper 54 may be configured with or otherwise include a lattice structure 154; e.g., a lattice structure body. This lattice structure 154 may include one or more repeated cells, where each cell may include a plurality (e.g., a pattern) of interconnected elements 156; e.g., columns.

Figure 10:
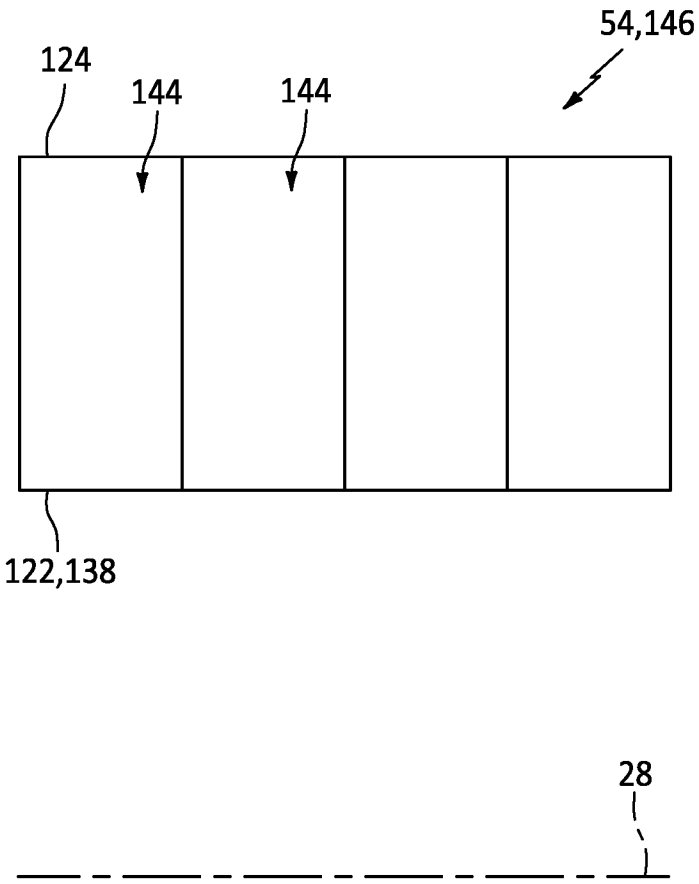
FIG. 10 is a sectional illustration of a portion of the bumper configured with a radially uniform construction.

Referring to FIG. 10, the structure/configuration of the bumper 54 may be uniform axially across an axial length of the bumper 54 between and to the bumper ends 118 and 120 (see FIG. 1). The structure/configuration of the bumper 54 may be uniform circumferentially about (e.g., completely around) the rotational axis 28. The structure/configuration of the bumper 54 may also be uniform radially across the (e.g., radial) height 142 (see FIG. 6A) of the bumper 54 between and to the bumper sides 122 and 124. Such an arrangement may provide the bumper 54 with a uniform damping characteristic. In other embodiments however, referring to FIGS. 11 and 12, the structure/configuration of the bumper 54 may be non-uniform to tailor the bumper 54 with a progressive stiffness characteristic and/or a progressive damping characteristic.

Figure 11:
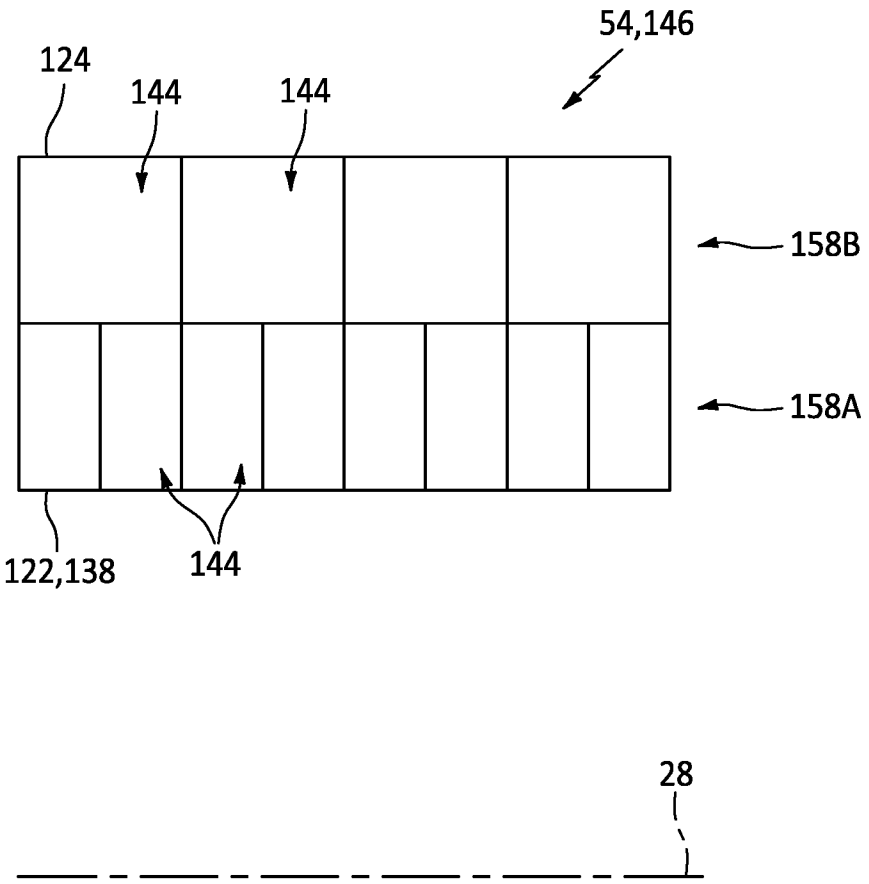
FIGS. 11-13 are sectional illustrations of portions of the bumper configured with radially varied constructions.

Referring to FIG. 11, an inner portion 158A (e.g., radial zone) of the bumper 54 may be configured with a different stiffness characteristic and/or a different damping characteristic than an outer portion 158B (e.g., radial zone) of the bumper 54. The bumper inner portion 158A is configured to deform (e.g., crush) when subject to an inner portion load. The bumper outer portion 158B is configured to deform (e.g., crush) when subject to an outer portion load, where the outer portion load is different (e.g., greater or less) than the inner portion load. The bumper inner portion 158A, for example, may be configured with an inner portion porosity and an inner portion density. The bumper outer portion 158B may be configured with an outer portion porosity and an outer portion density, where the outer portion porosity is different (e.g., greater or less) than the inner portion porosity and the outer portion density is different (e.g., less or greater) than the inner portion density. For example, the bumper inner portion 158A may be provided with an inner portion number of the internal cavities 144, where each of those internal cavities 144 has an inner portion dimension (e.g., diameter, length, etc.). The bumper outer portion 158B may be provided with an outer portion number of the internal cavities 144, where each of those internal cavities 144 has an outer portion dimension (e.g., diameter, length, etc.). The inner portion number may be different (e.g., greater or less) than or equal to the outer portion number. The inner portion dimension may be different (e.g., greater or less) than or equal to the outer portion dimension.

For ease of illustration, the bumper inner portion 158A of FIG. 11 is shown with a greater density than the bumper outer portion 158B. However, in other embodiments, the bumper outer portion 158B may have a greater density than the bumper inner portion 158A.

The bumper 54 is described above as including two (the inner and outer) portions 158A and 158B for tuning the stiffness characteristic and/or the damping characteristic. However, the bumper 54 may include more than two bumper portions; e.g., radial zones. For example, referring to FIG. 12, the bumper 54 may also include an intermediate portion 158C radially between the bumper inner portion 158A and the bumper outer portion 158B. Each of these bumper portions 158A-C (generally referred to as "158") may be configured with a unique structure. Each of the bumper portions 158, for example, may be configured to deform (e.g., crush) when subject to a different load. Alternatively, some of the bumper portions 158 (e.g., 158A and 158B), but not all of the bumper portions 158 (e.g., 158C) for example, may be configured with a common structure. Any two of the bumper portions 158, for example, may be configured to deform (e.g., crush) when subject to a first load whereas the remaining bumper portion 158 may be configured to deform (e.g., crush) when subject to a different (e.g., larger or small) second load.

Figure 13:
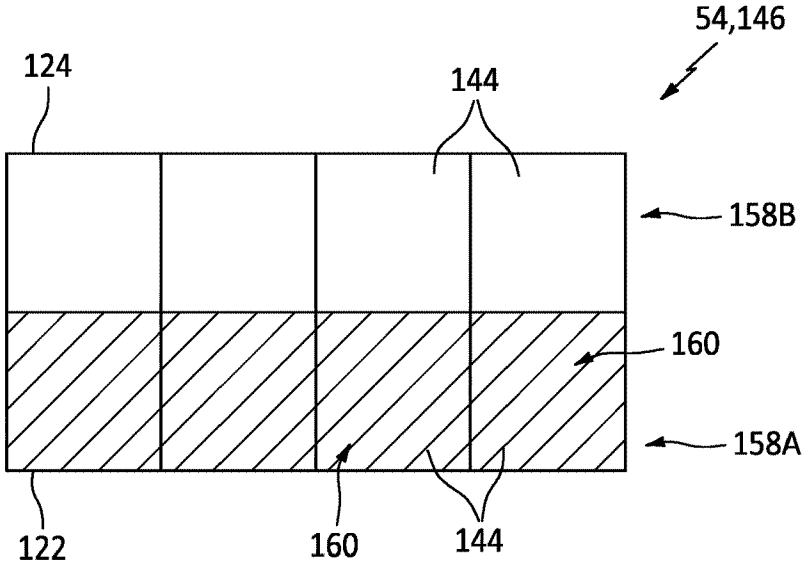

In some embodiments, referring to FIG. 13, the bumper 54 may be further tailored by at least partially or completely filling one or more of the internal cavities 144 with filler material 160. The cavities 144 in the bumper inner portion 158A of FIG. 13, for example, are filled with the filler material 160, whereas the cavities 144 in the bumper outer portion 158B are empty. Of course, in other embodiments, the cavities 144 in the bumper outer portion 158B may be filled with the filler material 160, and the cavities 144 in the bumper inner portion 158A may be empty (or partially or completely filled with the same filler material 160 or a different filler material). Examples of the filler material 160 include, but are not limited to, a polymer material and a potting material.

Figure 12:
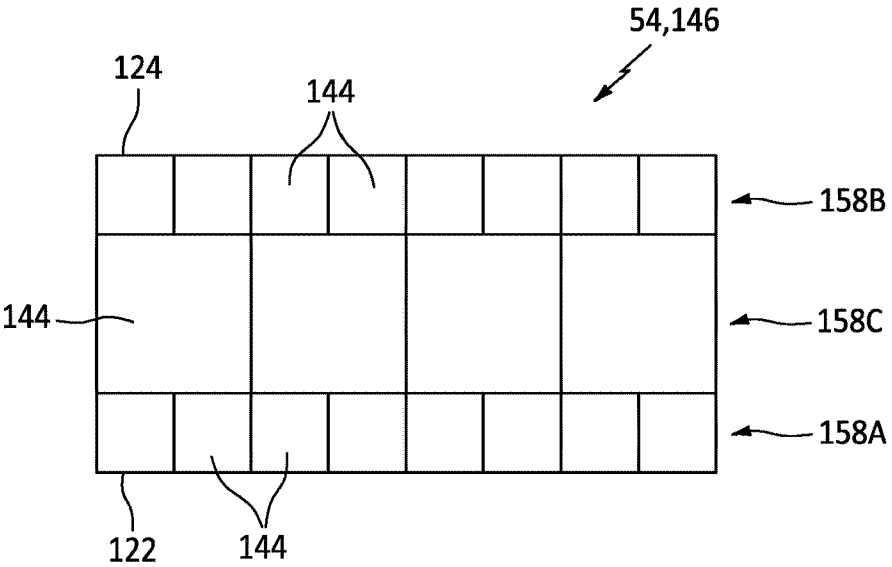

For ease of illustration, the bumpers 54 of FIGS. 11-13 are shown with honeycomb cores. However, the foregoing teachings may also be applied to bumpers 54 with other configurations. For example, the porosity, the density, the number of internal cavities 144, the dimensions of the internal cavities 144 and/or whether or not the internal cavities 144 are filled or empty may be tailored for the foam 150, 152 or the lattice structure 154. Furthermore, it is also contemplated that the different portions 158 of the bumper 54 may be tailored with different internal structures. For example, one of the bumper portions 158 may have a honeycomb configuration whereas another one of the bumper portions 158 may have a foam configuration, etc. The present disclosure therefore is not limited to the foregoing exemplary bumper configurations.

Figure 14:
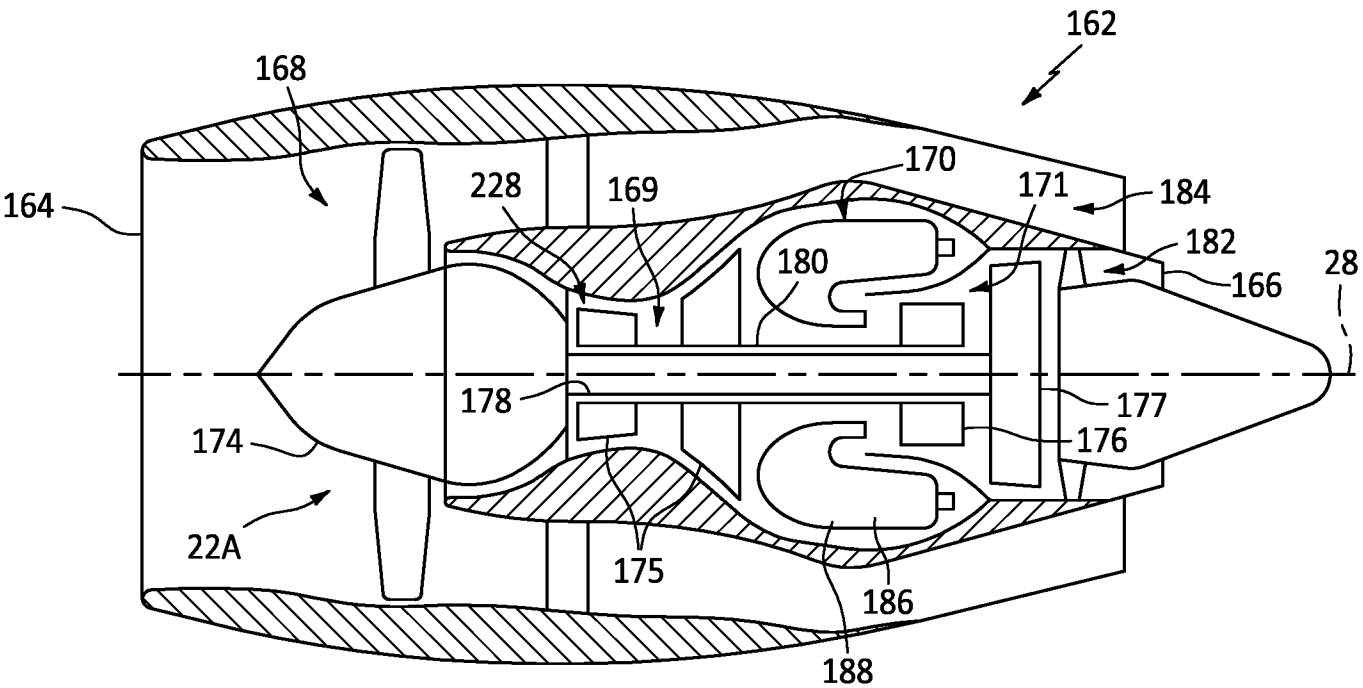
FIG. 14 is a schematic sectional illustration of a turbofan gas turbine engine.

FIG. 14 illustrates an example of the turbine engine with which the turbine engine assembly 20 may be configured. This turbine engine is configured as a turbofan gas turbine engine 162. This turbine engine 162 of FIG. 14 extends along the rotational axis 28 between an upstream airflow inlet 164 and a downstream airflow exhaust 166. The turbine engine 162 includes a fan section 168, a compressor section 169, a combustor section 170 and a turbine section 171.

The fan section 168 includes a fan rotor 174. The compressor section 169 includes a compressor rotor 175. The turbine section 171 includes a high pressure turbine (HPT) rotor 176 and a low pressure turbine (LPT) rotor 177, where the LPT rotor 177 is configured as a power turbine rotor. Each of these rotors 174-177 includes a plurality of rotor blades arranged circumferentially around and connected to one or more respective rotor disks.

The fan rotor 174 is connected to the LPT rotor 177 through a low speed shaft 178, which provides a low speed rotating structure 22A. The compressor rotor 175 is connected to the HPT rotor 176 through a high speed shaft 180, which provides a high speed rotating structure 22B. The rotating structure 22 of FIG. 1 may be configured as or otherwise included in either of the low speed rotating structure 22A or the high speed rotating structure 22B, and the shaft 30 may be configured as or otherwise included in the respective shaft 178, 180.

During operation, air enters the turbine engine 162 through the airflow inlet 164. This air is directed through the fan section 168 and into a core flowpath 182 (e.g., the flowpath 116 of FIG. 1) and a bypass flowpath 184. The core flowpath 182 extends sequentially through the engine sections 169-171; e.g., an engine core. The air within the core flowpath 182 may be referred to as "core air". The bypass flowpath 184 extends through a bypass duct, which bypasses the engine core. The air within the bypass flowpath 184 may be referred to as "bypass air".

The core air is compressed by the compressor rotor 175 and directed into a combustion chamber 186 of a combustor 188 in the combustor section 170. Fuel is injected into the combustion chamber 186 and mixed with the compressed core air to provide a fuel-air mixture. This fuel-air mixture is ignited and combustion products thereof flow through and sequentially cause the HPT rotor 176 and the LPT rotor 177 to rotate. The rotation of the HPT rotor 176 drives rotation of the compressor rotor 175 and, thus, compression of air received from an inlet into the core flowpath 182. The rotation of the LPT rotor 177 drives rotation of the fan rotor 174, which propels bypass air through and out of the bypass flowpath 184. The propulsion of the bypass air may account for a significant portion (e.g., a majority) of thrust generated by the turbine engine 162.

The turbine engine assembly 20 and/or its bumper 54 may be included in various turbine engines other than the ones described above. The turbine engine assembly 20 and/or its bumper 54, for example, may be included in a geared turbine engine where a gear train connects one or more shafts to one or more rotors in a fan section, a compressor section and/or any other engine section. Alternatively, the turbine engine assembly 20 and/or its bumper 54 may be included in a turbine engine configured without a gear train; e.g., a direct drive turbine engine. The turbine engine assembly 20 and/or its bumper 54 may be included in a geared or non-geared turbine engine configured with a single spool, with two spools (e.g., see FIG. 14), or with more than two spools. The turbine engine may be configured as a turbofan engine, a turbojet engine, a turboprop engine, a turboshaft engine, a propfan engine, a pusher fan engine, an auxiliary power unit (APU) or any other type of turbine engine. The present disclosure therefore is not limited to any particular types or configurations of turbine engines. In addition, while the turbine engine is described above for use in an aircraft application, the present disclosure is not limited to such aircraft applications. For example, the turbine engine may alternatively be configured as an industrial gas turbine engine, for example, for a land based power plant.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An assembly for a turbine engine, comprising:

a stationary structure;

a rotating structure rotatable about an axis relative to the stationary structure; and a bearing supporting the rotating structure;

the stationary structure including a flexible bearing support and a crushable bumper, the flexible bearing support supporting the bearing, and the crushable bumper arranged radially outward of and axially overlapping the flexible bearing support;

the stationary structure configured such that the flexible bearing support is disengaged from the crushable bumper during a first mode of operation; and the flexible bearing support contacts the crushable bumper during a second mode of operation.

2. The assembly of claim 1, wherein an annular gap is formed radially between the flexible bearing support and the crushable bumper during the first mode of operation.

3. The assembly of claim 1, wherein the flexible bearing support is further configured to crush the crushable bumper during the second mode of operation.

4. The assembly of claim 1, wherein the flexible bearing support is further configured to permanently deform the crushable bumper during the second mode of operation.

5. The assembly of claim 1, wherein the crushable bumper circumscribes the flexible bearing support.

6. The assembly of claim 1, wherein a first portion of the crushable bumper is configured to crush when subject to a first load; and a second portion of the crushable bumper is configured to crush when subject to a second load that is different than the first load.

7. The assembly of claim 6, wherein the first load is greater than the second load; and the first portion of the crushable bumper is arranged radially between the second portion of the crushable bumper and the flexible bearing support.

8. The assembly of claim 6, wherein the first load is greater than the second load; and the second portion of the crushable bumper is arranged radially between the first portion of the crushable bumper and the flexible bearing support.

9. The assembly of claim 6, wherein the first portion of the crushable bumper includes a first cavity with a first dimension in a direction; and the second portion of the crushable bumper includes a second cavity with a second dimension in the direction, and the second dimension is different than the first dimension.

10. The assembly of claim 6, wherein the first portion of the crushable bumper has a first porosity; and the second portion of the crushable bumper has a second porosity that is different than the first porosity.

11. The assembly of claim 6, wherein the first portion of the crushable bumper includes an empty cavity; and the second portion of the crushable bumper includes a cavity at least partially filled with filler material.

12. The assembly of claim 1, wherein the crushable bumper comprises honeycomb.

13. The assembly of claim 1, wherein the crushable bumper comprises foam.

14. The assembly of claim 1, wherein the crushable bumper comprises a lattice structure.

15. The assembly of claim 1, wherein the stationary structure further includes a fixed support, and the crushable bumper is mounted to the fixed support.

16. The assembly of claim 15, wherein a radial outer side of the fixed support is configured to form a peripheral boundary of a flowpath within the turbine engine.

17. The assembly of claim 1, wherein the flexible bearing support is a cantilevered from another portion of the stationary structure; and the bearing is supported by a distal, unsupported end portion of the flexible bearing support.

18. The assembly of claim 1, wherein the flexible bearing support includes a mount section, a bearing support section and a spring section axially between and connected to the mount section and the bearing support section;

the bearing is mounted to the bearing support section; and the spring section includes a plurality of slots arranged circumferentially about a rotational axis of the rotating structure, and each of the plurality of slots extends radially through the spring section.

19. An assembly for a turbine engine, comprising:

a rotating structure;

a bearing supporting the rotating structure; and a stationary structure including a bearing support and a bumper;

the bearing support cantilevered from another portion of the stationary structure, the bearing support including a plurality of beams and a bearing support section, the plurality of beams distributed circumferentially about an axis and projecting axially along the axis to the bearing support section, wherein the bearing is mounted to the bearing support section at an unsupported end of the bearing support; and the bumper configured to deform when the bearing support section subjects the bumper to a radial load over a threshold.

20. An assembly for a turbine engine, comprising:

a rotating structure;

a bearing supporting the rotating structure;

a bearing support supporting the bearing; and a deformable bumper configured to damp radial movement of the bearing support, the deformable bumper comprising a porous structure with an inner portion and an outer portion, the inner portion radially between the outer portion and the bearing support, the inner portion having an inner portion density, and the outer portion having an outer portion density that is different than the inner portion density.

* * * * *